United States Patent [19]

Creighton et al.

[11] Patent Number: 4,955,610

[45] Date of Patent: Sep. 11, 1990

[54] DRIVING IRON GOLF CLUB HEAD

[76] Inventors: William W. Creighton, 1845 S. Las Palmas Cir., Mesa, Ariz. 85202; George T. Venetis, 508 E. Marlette Ave., Phoenix, Ariz. 85012

[21] Appl. No.: 316,082

[22] Filed: Feb. 27, 1989

[51] Int. Cl.[5] ..... A63B 53/04

[52] U.S. Cl. ..... 273/169; 273/80 A; 273/80 C; 273/167 H; 273/167 J

[58] Field of Search ..... 273/167–175, 273/80.2–80.9, 80 C, 77 A, 164, 77 R; D21/214, 220

[56] References Cited

U.S. PATENT DOCUMENTS

| | | | |
|---|---|---|---|
| D. 164,597 | 9/1951 | Penna | 273/169 X |
| D. 239,550 | 4/1976 | Timbrook | 273/167 A X |
| D. 244,703 | 6/1977 | Guzzle et al. | D21/220 |
| D. 269,101 | 5/1983 | Reymann et al. | D21/220 |
| 1,257,471 | 2/1918 | Fitzjohn et al. | 273/173 |
| 1,927,083 | 9/1933 | Davis | 273/175 X |
| 3,020,048 | 2/1962 | Carroll | 273/175 X |
| 3,810,631 | 5/1974 | Braly | 273/167 A |
| 3,834,700 | 9/1974 | Auerbach | 273/173 X |
| 3,947,041 | 3/1976 | Barber | 273/167 G |
| 3,995,865 | 12/1976 | Cochran | 273/167 F |
| 4,345,763 | 8/1982 | Swanson | 273/164 |
| 4,687,205 | 8/1987 | Tominaga et al. | 273/169 |

OTHER PUBLICATIONS

"Shamrock's Sand Wedge" as seen in *Golf Digest,* Dec. 1974, p. 68.

"Medallion Irons" as seen in *Golf Digest,* Aug. 1979, p. 25.

Ad for *Mark II Golf Clubs* as seen in Golf Digest, Dec. 1977, p. 135.

*Primary Examiner*—William H. Grieb
*Assistant Examiner*—Sebastiano Passaniti
*Attorney, Agent, or Firm*—Harry M. Weiss

[57] ABSTRACT

An iron type golf club includes a club head having a striking face having a heel integrally formed with a shank end portion of a hosel. A front surface of the shank end portion is provided with a taper that extends from a leading edge of the striking face upward and away from the striking face for a predetermined distance to provide increased stability to the heel when a golf ball does not contact the sweet spot of the striking face. A rear face of the club head is provided with a cavity having a weight connected adjacent a toe portion of the club head.

8 Claims, 1 Drawing Sheet

DRIVING IRON GOLF CLUB HEAD

BACKGROUND OF THE INVENTION

1. FIELD OF INVENTION

This invention relates generally to golf clubs and methods therefore and, more particularly, to a driving iron golf club head and method therefore.

2. DESCRIPTION OF THE PRIOR ART

A principal factor in a golfer not consistently attaining acceptable results when hitting a golf ball with an iron club, is a failure to cause what is known as the sweet spot of the club head to consistently strike the ball. The sweet spot is associated with the center of percussion of the club head. Center of percussion is well defined in the mechanical arts.

A close approximation to the size of the sweet spot may be determined by what is known as a tap test. In the tap test, an observer suspends the handle of the iron club with two fingers. The observer then taps the striking face of the club head with a coin or the like. In response to the tapping, the club head oscillates when the sweet spot is not tapped. Conversely, the club head does not oscillate when the sweet spot is tapped.

For reasons that may be deduced from the tap test, when a portion of the club head, other than the sweet spot, strikes the ball, the golfer may feel an uncomfortable vibration via the shaft of the iron club. Additionally, the ball neither travels in a desired direction nor a desired distance.

In about 90% of the instances when the sweet spot does not strike the ball, the ball is struck by the heel, thereby causing the club head to oscillate. The oscillation causes a loss of distance of travel and an increased side spin of the ball, thereby causing a loss of accurracy.

Another factor in not consistently attaining acceptable results is the heel of the club head inadvertantly touching the ground during the golfer's attempt to hit the ball. The touching of the ground rotates the club head prior to the striking face thereof making contact with the ball. Accordingly, the ball neither travels in the desired direction nor the desired distance.

The striking face displaces a maximum amount of air almost immediately prior to contact with the ball. The air displacement typically causes the club head to oscillate. The oscillation prevents the toe of the club head from squaring to the line of flight of the ball at impact. Moreover the oscillation due to the air displacement is referred to as a destabilization of the toe. The destabilization is yet another factor in not consistantly attaining acceptable results.

When the iron club is used as a driver, it is desireable that the ball have a trajectory of reduced height to prevent wind from adversely influencing the distance and the direction of travel of the ball. The trajectory is usually undesireably high because the center of gravity of the club head does not extend far enough above the sole thereof.

Therefore, it as desireable for the golfer to have a driving iron club with a club head having an enlarged sweet spot, a shape that reduces the likelihood of the heel of the club head inadvertantly touching the ground, a heel that is stabilized, a toe that squares to the line of flight at impact, and a center of gravity that causes the ball to have a trajectory of reduced height in response to being struck by the striking face of the club head.

SUMMARY OF THE INVENTION

An object of the present invention is to provide an improved iron golf club head and method therefore.

Another object of the present invention is to provide an iron golf club head having an enlarged sweet spot.

Another object of the present invention is to provide an iron golf club head that is shaped to reduce the likelihood of the heel of the club head touching the ground when a golfer attempts to hit a golf ball.

Another object of the present invention is to provide a driving iron golf club with a center of gravity that causes a golf ball to have a trajectory of reduced height when the striking face of its club head strikes the ball.

Another object of the present invention is to provide a driving iron golf club with a stabilized heel.

According, to the present invention, an iron golf club head has a hosel integral with the striking face of the club head.

An iron club head of the present invention preferably has what is known as a reverse weight distribution, whereby the toe of the club head is heaviest near the sole and the heel of the club head is heaviest near the top.

An iron golf club head of the present invention has a striking face with a sweet spot of more than twice the area of the sweet spot of iron golf club heads of the prior art.

A weight is preferably included on the rear face of the iron club head of the present invention to square the toe of the club head at impact with a golf ball.

An iron club head of the present invention preferably has a sole with an arcuate shaped bottom that reduces the probability of the heel of the club head inadvertantly touching the ground when the club head is used.

These and other objects, features and advantages of the present invention, as well as details of the preferred embodiment thereof, will be more fully understood from the following description and drawing.

DESCRIPTION OF THE PREFERRED EMBODIMENT

Figure 1:
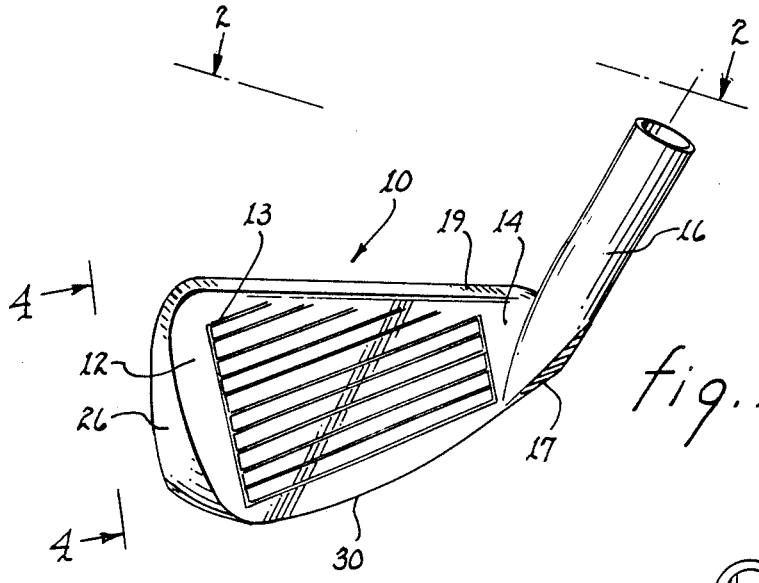
FIG. 1 is a perspective view of the striking face of the preferred embodiment of the present invention.
Figure 4:
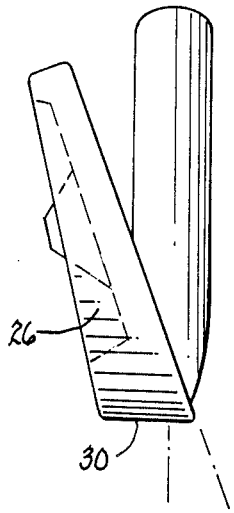
FIG. 4 is a view of the embodiment of FIG. 1 taken along the line 4—4.
Figure 2:
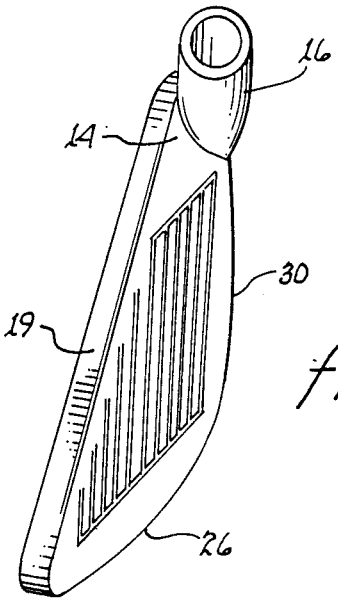
FIG. 2 view of the embodiment of FIG. 1 taken along the line 2—2.

Referring to FIGS. 1—5 an iron golf club head 10 has a striking face 12 with score marks 13, similar to score marks on club heads of the prior art. Club head 10 has a heel 14 whereat a hose 16 is integrally formed to face 12. Preferably, the front surface of shank end portion 17 of hosel 16 is tapered. The back surface of shank end portion 17 contacts the striking face 12. As shown in FIG. 4, the striking face 12 is positioned at an angle so that the bottom edge of the face 12 leads the face 12 and the top edge of the face 12 trails the face 12 during a swing. The connection of hosel 16 to face 12 causes face 12 to appear to be wrapped around hosel 16 (FIG. 2). Moreover, the taper causes heel 14 to have its largest concentration of weight near the top 19 of club head 10.

Figure 5:
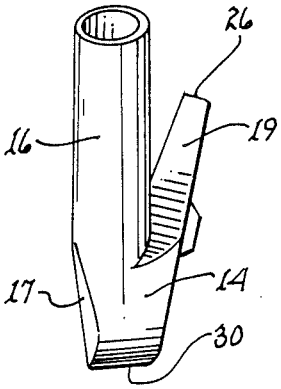
FIG. 5 is a perspective of a hosel in the embodiment of FIG. 1.
Figure 3:
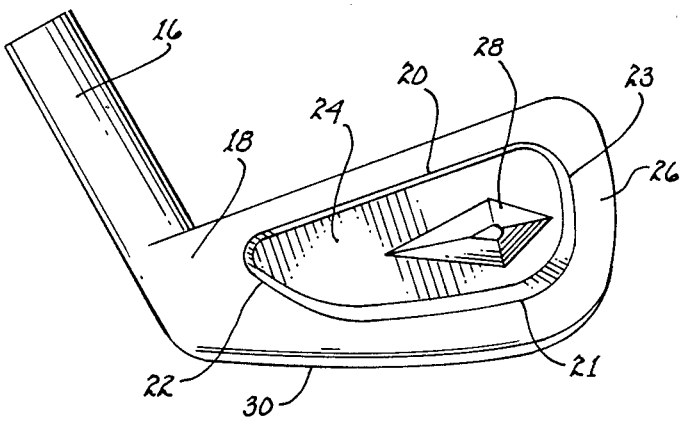
FIG. 3 is a rear view of the embodiment of FIG. 1.

As shown in FIG. 1 and 5, the taper on the front surface of the shank end portion 17 extends from the leading edge of the striking face 12 upward and away from the striking face 12 to a height about equal to the height of the heel 14.

According to the present invention, the connection of hosel 16 to face 12 causes club head 10 to have an enlarged sweet spot that substantially includes heel 14. Because heel 14 is substantially included in the sweet spot, heel 14 is said to be stabilized.

Club head 10 has a rear face 18 (FIG. 3) that includes edge portions 20–23 which form a cavity 24. The forming of cavity 24 is in accordance with techniques well known in the prior art.

Within cavity 24, a weight 28 is integrally connected substantially midway between edges 20, 21 and adjacent to the toe 26 of club head 10. Weight 28 and hosel 16 are made from the same material as club head 10. Preferably, the material is either titanium or a titanium alloy. Alternatively, face 12 can be plated with either titanium or a titanium alloy.

Weight 28 is selected to provide an increase in momentum near toe 26 when club head 10 moves to displace large amounts of air, thereby squaring toe 26 at impact with a golf ball. Weight 28 additionally causes the sweet spot to extend substantially to an area of club head 10 adjacent to toe 26. Moreover, with the connection of hosel 16 and the connection of weight 28, the sweet spot extends substantially from an area adjacent to the sole 30 of club head 10 to an area adjacent to top 19.

Because of extent of the sweet spot, a golf ball may, for example, be struck close to the center of face 10, thereby causing the ball to have a trajectory of reduced height.

As best shown in FIGS. 1 and 4, toe 26 is thickest near sole 30, whereby toe 26 has its greatest concentration of weight near sole 30. Since heel 14 has its greatest concentration of weight near top 19 and toe 26 has its largest concentration of weight near sole 30, club head 10 is said to have what is known as a reverse weight distribution.

Preferably, sole 30 has a convex arcuate shape. The arcuate shape reduces the probability of heel 14 inadvertantly touching the ground when club head 10 is used.

Although club head 10 may be of any suitable size, preferably, face 12 has an area 20% to 30% larger than most iron club heads of the prior art.

While the invention has been particularly shown and described with reference to a preferred embodiment thereof, it will be understood by those skilled in the art that changes in form and detail may be made therein without departing from the spirit and the scope of the invention.

We claim:

1. An iron golf club comprising:

a hosel having a shank end portion, said shank end portion having a front and back surface; and a club head having a sole, a top, a toe, a heel, a rear fall, and a striking face, said striking face having a leading edge, and a trailing edge, said heel integrally formed with said shank end portion, said striking face having a configuration that contacts said back surface of said shank end portion, said front surface of said shank end portion having a tapered portion, said tapered portion extending from said leading edge of said striking face upward and away from said striking face for a predetermined distance.

2. The club of claim 1 wherein the thickness of said sole at the toe of said club head is greater than the thickness of said sole at said heel of said club head, said toe of said club head being heaviest near said sole of said club head and said heel being heaviest near said top of said club head.

3. The club of claim 1 wherein a cavity is formed in the rear face of said club head, additionally comprising a weight connected in said cavity adjacent to the toe of said club head.

4. The club of claim 3 wherein said club head, said hosel and said weight are made from titanium.

5. The club of claim 3 wherein said club head, said hosel and said weight are made form a titanium alloy.

6. The club of claim 1 wherein said striking face is plated with titanium.

7. The club of claim 1 wherein said striking face is plated with a titanium alloy.

8. The club of claim 1 wherein the sole of said club head has a convex arcuate shape.

* * * * *